US009689059B2

(12) United States Patent
Chung et al.

(10) Patent No.: US 9,689,059 B2
(45) Date of Patent: Jun. 27, 2017

(54) HIGH STRENGTH FLAKE GRAPHITE CAST IRON HAVING EXCELLENT WORKABILITY AND PREPARATION METHOD THEREOF

(71) Applicant: DOOSAN INFRACORE CO., LTD., Incheon (KR)

(72) Inventors: Jong Kwon Chung, Gyeonggi-do (KR); Sik Yang, Gyeonggi-do (KR); Ki Hwan Jung, Gyeonggi-do (KR); Jae Hyoung Hwang, Gyeonggi-do (KR)

(73) Assignee: Doosan Infracore Co., Ltd., Incheon (KR)

( * ) Notice: Subject to any disclaimer, the term of this patent is extended or adjusted under 35 U.S.C. 154(b) by 406 days.

(21) Appl. No.: 14/220,746

(22) Filed: Mar. 20, 2014

(65) Prior Publication Data

US 2014/0286819 A1 Sep. 25, 2014

(30) Foreign Application Priority Data

Mar. 22, 2013 (KR) ..... 10-2013-0030966

(51) Int. Cl.

| | |
|---|---|
| ***B22D 23/02*** | (2006.01) |
| ***C22C 37/10*** | (2006.01) |
| ***B22D 25/06*** | (2006.01) |
| ***C22C 33/08*** | (2006.01) |
| ***C21C 1/08*** | (2006.01) |
| *C21C 7/00* | (2006.01) |

(52) U.S. Cl.

CPC ..... *C22C 37/10* (2013.01); *B22D 23/02* (2013.01); *B22D 25/06* (2013.01); *C21C 1/08* (2013.01); *C22C 33/08* (2013.01); *C21C 7/0056* (2013.01)

(58) Field of Classification Search

None

See application file for complete search history.

(56) References Cited

U.S. PATENT DOCUMENTS

| | | | | |
|---|---|---|---|---|
| 1,707,753 | A * | 4/1929 | Boegehold | C22C 37/10 148/322 |
| 2,485,761 | A * | 10/1949 | Millis | C22C 37/04 420/13 |
| 5,242,510 | A * | 9/1993 | Begin | C22C 37/10 148/321 |
| 5,759,298 | A * | 6/1998 | Williamson | F04C 2/025 148/321 |
| 7,163,594 | B1 * | 1/2007 | Tandon | C22C 37/10 148/321 |
| 7,419,554 | B2 * | 9/2008 | Eriksson | C22C 37/10 148/321 |
| 2010/0239451 | A1 * | 9/2010 | Horie | C22C 37/10 420/15 |
| 2012/0087824 | A1 * | 4/2012 | Mol de Oliveira | C21C 1/08 420/15 |

* cited by examiner

*Primary Examiner* — Colleen Dunn

(74) *Attorney, Agent, or Firm* — John D. Veldhuis-Kroeze; Westman, Champlin & Koehler, P.A.

(57) ABSTRACT

The present disclosure relates to flake graphite cast iron having high workability and a preparation method thereof, and more particularly, to flake graphite cast iron with a uniform graphite shape, low chill formability, a high strength such as a tensile strength of 350 MPa or more, and excellent workability and fluidity by controlling each of the contents of manganese (Mn) and sulfur (S) and carbon (C) and silicon (Si) included in the cast iron and a carbon equivalent (CE) to predetermined ratios, and a preparation method thereof.

7 Claims, 3 Drawing Sheets

HIGH STRENGTH FLAKE GRAPHITE CAST IRON HAVING EXCELLENT WORKABILITY AND PREPARATION METHOD THEREOF

CROSS-REFERENCE TO RELATED APPLICATIONS

This application is based on and claims priority from Korean Patent Application No. 10-2013-0030966, filed on Mar. 22, 2013, with the Korean Intellectual Property Office, the disclosure of which is incorporated herein in its entirety by reference.

FIELD OF THE DISCLOSURE

The present disclosure relates to high strength flake graphite cast iron having excellent workability and a preparation method thereof, and more particularly, to flake graphite cast iron with a uniform graphite shape, low chill formability, a high strength such as a tensile strength of 350 MPa or more, and excellent workability by controlling each of a content ratio (Mn/S) of manganese (Mn) and sulfur (S) included in the cast iron, a ratio [(Mn/S)/(C/Si)] of the content ratio (Mn/S) of manganese and sulfur to a content ratio of carbon and silicon, and a carbon equivalent (CE) to predetermined ratios, and a preparation method thereof.

BACKGROUND OF THE DISCLOSURE

Due to the recent reinforcement of environmental regulations, it is essentially required that the content of environmental contaminants emitted from engines is reduced, and in order to solve the problem, it is necessary to raise the combustion temperature by increasing the explosion pressure of the engine. When the explosion pressure of the engine is increased as described above, the strength of the engine cylinder block and head constituting the engine needs to be high in order to withstand the explosion pressure.

A material currently used for the engine cylinder block and head is flake graphite cast iron to which a trace of alloy iron such as chromium (Cr), copper (Cu) and tin (Sn) is added. The flake graphite cast iron has excellent thermal conductivity and vibration damping capacity and a trace of added alloy iron, and thus has excellent castability as well as low chilling probability. However, since the tensile strength is in a range from approximately 150 to 250 MPa, there is limitation in using the flake graphite cast iron for an engine cylinder block and head which requires explosion pressure of more than 180 bar.

Meanwhile, a material for the engine cylinder block and head for withstanding an explosion pressure more than 180 bar is required to have high strength such as a tensile strength of approximately 300 MPa. For this purpose, a pearlite stabilizing element such as copper (Cu) and tin (Sn) or a carbide production promoting element such as chromium (Cr) and molybdenum (Mo) needs to be further added, but since the addition of such an alloy iron potentially induces the chilling tendency, there is a problem of increasing the likelihood that chills occur at a part such as a thin-walled part of an engine cylinder block and head having a complicated shape. When a large number of chills occur, brittleness of a material increases and the material becomes vulnerable to impact, and there are problems in that physical properties deteriorate and the workability deteriorates.

Recently, compacted graphite iron (CGI) cast iron having excellent castability, vibration damping capacity and thermal conductivity of flake graphite cast iron and simultaneously satisfying a high tensile strength of 300 MPa or more has been applied as a material for an engine cylinder block and head having a high explosion pressure. In order to make a CGI cast iron having a tensile strength of 300 MPa or more, high-quality pig iron having a low content of impurities such as sulfur (S) and phosphorus (P), and a molten material need to be used, and it is necessary to precisely control magnesium (Mg) which is a graphite-spheroidizing element. However, since it is difficult to control magnesium (Mg) and magnesium is very sensitive to a change in melting and casting conditions, such as pouring temperature and pouring rate, it is highly likely that material defects and casting defects of CGI cast iron occur, and there is a problem in that the costs of production increase.

Since CGI cast iron has relatively worse workability than flake graphite cast iron, when an engine cylinder block and head is prepared using CGI cast iron, processing is not performed in a processing line dedicated to the existing flake graphite cast iron and it is necessary to change the processing line into a processing line dedicated to CGI cast iron. Therefore, there is a problem concerning the occurrence of enormous facility investment costs.

SUMMARY

The present disclosure has been made in an effort to solve the aforementioned problem, and one aspect of the present disclosure is to provide flake graphite cast iron having a high strength and excellent workability by adding alloy elements to carbon (C), silicon (Si), manganese (Mn), sulfur (S), and phosphorus (P), which are five main elements in cast iron, and simultaneously controlling a carbon equivalent (CE), a content ratio (Mn/S) of manganese and sulfur, and a ratio [(Mn/S)/(C/Si)] of the content ratio (Mn/S) of manganese and sulfur to a content ratio of carbon and silicon, to respective predetermined ranges, and a preparation method thereof.

The present disclosure has also been made in an effort to provide cast iron which is controlled to have the aforementioned specific content ratio and has stable physical properties and structures, and particularly, flake graphite cast iron which is applicable to a large and medium-sized engine cylinder block and/or a large and medium-sized engine cylinder head, having a complicated shape.

An exemplary embodiment of the present disclosure provides flake graphite cast iron comprising 3.05 to 3.25% of carbon (C), 2.1 to 2.4% of silicon (Si), 0.6 to 3.4% of manganese (Mn), 0.09 to 0.13% of sulfur (S), 0.04% or less of phosphorus (P), 0.6 to 0.8% of copper (Cu), 0.2 to 0.4% of molybdenum (Mo) and the balance iron (Fe) satisfying 100% as a total weight %, and simultaneously satisfying a chemical composition, in which the ratio (Mn/S) of the content of manganese (Mn) to the content of sulfur (S) is in a range from 7 to 28, the ratio [(Mn/S)/(C/Si)] of the content ratio of manganese and sulfur to the content ratio of carbon and silicon is in a range from 5 to 18, and the carbon equivalent (CE) is in a range from 3.8 to 4.0.

The flake graphite cast iron may have a tensile strength of 350 MPa or more.

The flake graphite cast iron may have a processing length of 6 m or more when the VBmax value, which shows abrasion of tool tips, is 0.45 during the evaluation of workability of a workability test specimen. In the flake graphite cast iron, a wedge test specimen may have a chill depth of 3 mm or less.

Another exemplary embodiment of the present disclosure provides a preparation method of the aforementioned flake graphite cast iron having high workability.

The preparation method may comprise: (i) preparing a cast iron melt comprising 3.05 to 3.25% of carbon (C), 2.1 to 2.4% of silicon (Si), 0.6 to 3.4% of manganese (Mn), 0.09 to 0.13% of sulfur (S), 0.04% or less of phosphorus (P), 0.6 to 0.8% of copper (Cu), 0.2 to 0.4% of molybdenum (Mo) and the balance iron (Fe) based on a total weight %, in which a chemical composition of the cast iron melt is adjusted such that a ratio (Mn/S) of a content of manganese (Mn) to a content of sulfur (S) is in a range from 7 to 28, a ratio [(Mn/S)/(C/Si)] of a content ratio of manganese and sulfur to a content ratio of carbon and silicon is in a range from 5 to 18, and a carbon equivalent (CE) is in a range from 3.8 to 4.0; and (ii) pouring the prepared cast iron melt into a ladle and injecting the cast iron melt into a prepared mold.

The cast iron melt in step (i) may be prepared by adding 0.6 to 0.8% of copper (Cu) and 0.2 to 0.4% of molybdenum (Mo) to a cast iron melt prepared by melting a cast iron material including 3.05 to 3.25% of carbon (C), 2.1 to 2.4% of silicon (Si), 0.6 to 3.4% of manganese (Mn), 0.09 to 0.13% of sulfur (S), 0.04% or less of phosphorus (P) and the balance iron (Fe) based on a total weight % in a furnace.

It is preferred that an Fe—Si-based inoculant is added one or more times in step (ii). More specifically, the Fe—Si-based inoculant may be added when the cast iron melt is poured into the ladle, when the cast iron melt is injected into the prepared mold, or in all the steps.

According to the present disclosure, the tensile strength, the chill depth and the workability may vary depending on the carbon equivalent (CE), the ratio (Mn/S) of manganese (Mn) and sulfur (S) added, and the ratio [(Mn/S)/(C/Si)] of the content ratio of manganese and sulfur to the content ratio of carbon and silicon, and in order to be applied to parts having a complicated shape, the flake graphite cast iron needs to simultaneously satisfy the carbon equivalent (CE), the Mn/S ratio, and the ratio [(Mn/S)/(C/Si)] of the content ratio of manganese and sulfur to the content ratio of carbon and silicon in a range from 3.8 to 4.0, 7 to 28, and 5 to 18, respectively.

According to the exemplary embodiments of the present disclosure, it is possible to provide flake graphite cast iron having a high tensile strength of 350 MPa or more and excellent workability by precisely controlling the contents of carbon (C) and silicon (Si) added to the cast iron, the amount of manganese (Mn) and sulfur (S) added, the ratio [(Mn/S)/(C/Si)] of the content ratio of manganese and sulfur to the content ratio of carbon and silicon, and the carbon equivalent (CE).

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
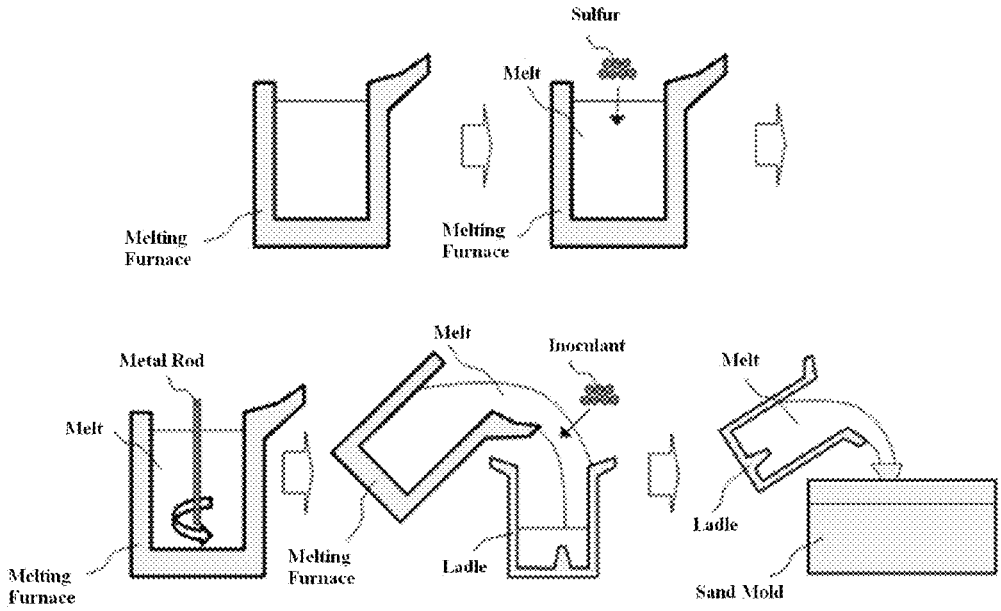
FIG. 1 schematically illustrates an example of a preparation process of high strength flake graphite cast iron for an engine cylinder block and head according to the present disclosure.

In the following detailed description, reference is made to the accompanying drawing, which forms a part hereof. The illustrative embodiments described in the detailed description, drawing, and claims are not meant to be limiting. Other embodiments may be utilized, and other changes may be made, without departing from the spirit or scope of the subject matter presented here.

Hereinafter, the present disclosure will be described in detail with reference to specific embodiments.

In the present disclosure, copper (Cu) and molybdenum (Mo) are used as components of the cast iron, in which the content ratio (Mn/S) of manganese (Mn) and sulfur (S), the ratio [(Mn/S)/(C/Si)] of the content ratio of manganese and sulfur to the content ratio of carbon and silicon, and the carbon equivalent (CE) in the cast ion are controlled to respective predetermined ranges.

When the content ratio is adjusted to the predetermined content ratio as described above, a high strength and excellent workability may be simultaneously achieved by suppressing the reaction chillation and aiding in the growth and crystallization of good A-type flake graphite because manganese (Mn) is each reacted with sulfur (S) in the cast iron to form an MnS sulfide and the MnS formed serves as a strong nucleation site in which flake graphite may be grown.

In this case, the carbon equivalent (CE), the content ratio (Mn/S) of manganese and sulfur, and the ratio [(Mn/S)/(C/Si)] of the content ratio of manganese and sulfur to the content ratio of carbon and silicon are the most important factors in preparing high strength flake graphite cast iron having a tensile strength of 350 MPa or more and excellent workability. Accordingly, the flake graphite cast iron of the present disclosure needs to be limited to the preparation method exemplified below and the corresponding chemical composition.

Hereinafter, the chemical composition of the flake graphite cast iron according to the present disclosure and the preparation method of the flake graphite cast iron will be described. Herein, the amount of each element added is represented as wt %, and will be represented simply as % in the following description.

<Flake Graphite Cast Iron>

The high strength and high workability flake graphite cast iron according to the present disclosure includes 3.05 to 3.25% of carbon (C), 2.1 to 2.4% of silicon (Si), 0.6 to 3.4% of manganese (Mn), 0.09 to 0.13% of sulfur (S), 0.04% or less of phosphorus (P), 0.6 to 0.8% of copper (Cu), 0.2 to 0.4% of molybdenum (Mo) and the balance iron (Fe) satisfying 100% as a total weight %, and has a chemical composition, in which the ratio (Mn/S) of the content of manganese (Mn) to the content of sulfur (S) is in a range from 7 to 28, the ratio [(Mn/S)/(C/Si)] of the content ratio of manganese and sulfur to the content ratio of carbon and silicon is in a range from 5 to 18, and the carbon equivalent (CE) is in a range from 3.8 to 4.0.

In the present disclosure, the reason for adding each component contained in the flake graphite cast iron and the reason for limiting the range of the content of each component added are as follows.

1) Carbon (C) 3.05 to 3.25%

Carbon is an element which crystallizes good flake graphite. When the content of carbon (C) in the flake graphite cast iron according to the present disclosure is less than 3.05%, D+E type graphite, which is not good flake graphite, is crystallized, thereby leading to high probability of occurrence of chills and incurring deterioration in workability. When the content of carbon (C) exceeds 3.25%, high strength flake graphite cast iron may not be obtained because a ferrite structure is formed as flake graphite is excessively crystallized, thereby leading to reduction of tensile strength. Accordingly, it is preferred that the content of carbon (C) in the present disclosure is limited to 3.05 to 3.25%.

2) Silicon (Si) 2.1 to 2.4%

When silicon (Si) and carbon are added at an optimum ratio, the amount of flake graphite crystallized may be maximized, the occurrence of chills is reduced, and the strength is increased. When the content of silicon (Si) in the flake graphite cast iron according to the present disclosure is less than 2.1%, deterioration in workability due to the formation of chills is caused, and when the content thereof exceeds 2.3%, high strength flake graphite cast iron may not be obtained due to reduction of tensile strength caused by excessive crystallization of flake graphite. Accordingly, it is preferred that the content of silicon (Si) in the present disclosure is limited to 2.1 to 2.3%.

3) Manganese (Mn) 0.6 to 3.4%

Manganese is an element which makes the interlayer spacing in pearlite dense and reinforces the matrix of flake graphite cast iron. When the content of manganese (Mn) in the flake graphite cast iron according to the present disclosure is less than 0.6%, it is difficult to obtain high strength flake graphite cast iron because the content fails to significantly affect the reinforcement of the matrix for obtaining a tensile strength of 350 MPa or more, and when the content of manganese (Mn) exceeds 3.4%, the effect of stabilizing carbides is more significant than the effect of reinforcing the matrix, so that the tensile strength is increased, but the chilling tendency increases, thereby incurring deterioration in workability. Accordingly, it is preferred that the content of manganese (Mn) in the present disclosure is limited to 0.6 to 3.4%.

4) Sulfur (S) 0.09 to 0.13%

Sulfur (S) is reacted with trace elements included in the melt to form sulfides, and the sulfide serves as a nucleation site of the flake graphite to aid in the growth of the flake graphite. In the flake graphite cast iron according to the present disclosure, high strength flake graphite cast iron may be prepared only when the content of sulfur (S) is 0.09% or more. When the content of sulfur (S) exceeds 0.13%, the tensile strength of the material is reduced and brittleness is increased due to the segregation of sulfur (S), and thus, it is preferred that the content of sulfur (S) according to the present disclosure is limited to 0.09 to 0.13%.

5) Phosphorus (P) 0.04% or Less

Phosphorus is a kind of impurity naturally added in the preparation process of cast iron in air. The phosphorus (P) stabilizes pearlite and is reacted with trace elements included in the melt to form a phosphide (steadite), thereby serving to reinforce the matrix and enhance abrasion resistance, but when the content of phosphorus (P) exceeds 0.06%, brittleness rapidly increases. Accordingly, it is preferred that the content of phosphorus (P) in the present disclosure is limited to 0.04% or less. In this case, the lower limit of the content of phosphorus (P) may exceed 0%, but needs not be particularly limited.

6) Copper (Cu) 0.6 to 0.8%

Copper (Cu) is an element which reinforces the matrix of flake graphite cast iron, and is an element necessary for securing strength because the element acts to promote the production of pearlite and make pearlite finer. In the high strength flake graphite cast iron for an engine cylinder block and head according to the present disclosure, when the content of copper (Cu) is less than 0.6%, insufficient tensile strength is incurred, but even though the addition amount thereof exceeds 0.8%, there is a problem in that the material costs are increased because an addition effect corresponding to the surplus is minimally obtained. Accordingly, it is preferred that the content of copper (Cu) in the present disclosure is limited to 0.6 to 0.8%.

7) Molybdenum (Mo) 0.2 to 0.4%

Molybdenum (Mo) is an element which reinforces the matrix of flake graphite cast iron, accordingly enhances the strength of the material, and also enhances the strength at high temperature. In the high strength flake graphite cast iron for an engine cylinder block and head according to the present disclosure, when the content of molybdenum (Mo) is less than 0.2%, it is difficult to obtain a tensile strength required for the present disclosure, and insufficient high temperature tensile strength occurs for being applied to an engine cylinder block and head in which the operating temperature is high when the explosion pressure is raised to 220 bar or more. Meanwhile, when the content of molybdenum (Mo) exceeds 0.4%, the tensile strength may be slightly increased because the effect of reinforcing the matrix is significant at high temperature, but workability significantly deteriorates due to production of Mo carbides, and there is a problem in that material costs are increased. Accordingly, it is preferred that the content of molybdenum (Mo) in the present disclosure is limited to 0.2 to 0.4%.

9) Iron (Fe)

Iron is a main material of the cast iron according to the present disclosure. The balance component other than the aforementioned components is iron (Fe), and other inevitable impurities may be partially included.

In the present disclosure, the chemical composition of the flake graphite cast iron is limited as described above, the carbon equivalent is adjusted in a range from 3.8 to 4.0, the content ratio (Mn/S) of manganese and sulfur is adjusted in a range from 7 to 28, and additionally, the ratio [(Mn/S)/(C/Si)] of the content ratio (Mn/S) of manganese and sulfur to the content ratio of carbon and silicon is simultaneously adjusted in a range from 5 to 18. Through this, even though manganese (Mn) is added in a large amount as an element which reinforces the matrix and stabilizes the carbides in order to prepare high strength flake graphite cast iron, it is possible to obtain a high strength flake graphite cast iron having a tensile strength of 350 MPa or more, reduced chillation, and excellent workability because the graphite shape is uniform and the chillation is reduced.

According to an example of the present disclosure, the tensile strength of the flake graphite cast iron having the aforementioned chemical composition is 350 MPa or more, and may be in a range preferably from 350 to 380 MPa.

Figure 2:
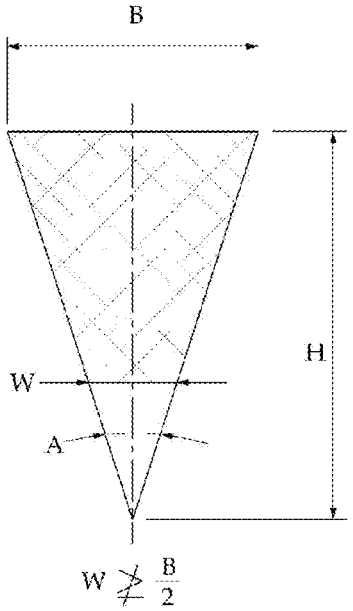
FIG. 2 illustrates a wedge test specimen for measuring a chill depth of the flake graphite cast iron according to the present disclosure.

According to an example of the present disclosure, the wedge test specimen to which the flake graphite cast iron having the chemical composition is applied has a chill depth of 3 mm or less. In this case, the wedge test specimen in which the chill depth is measured may be illustrated as in the following FIG. 2.

Figure 3:
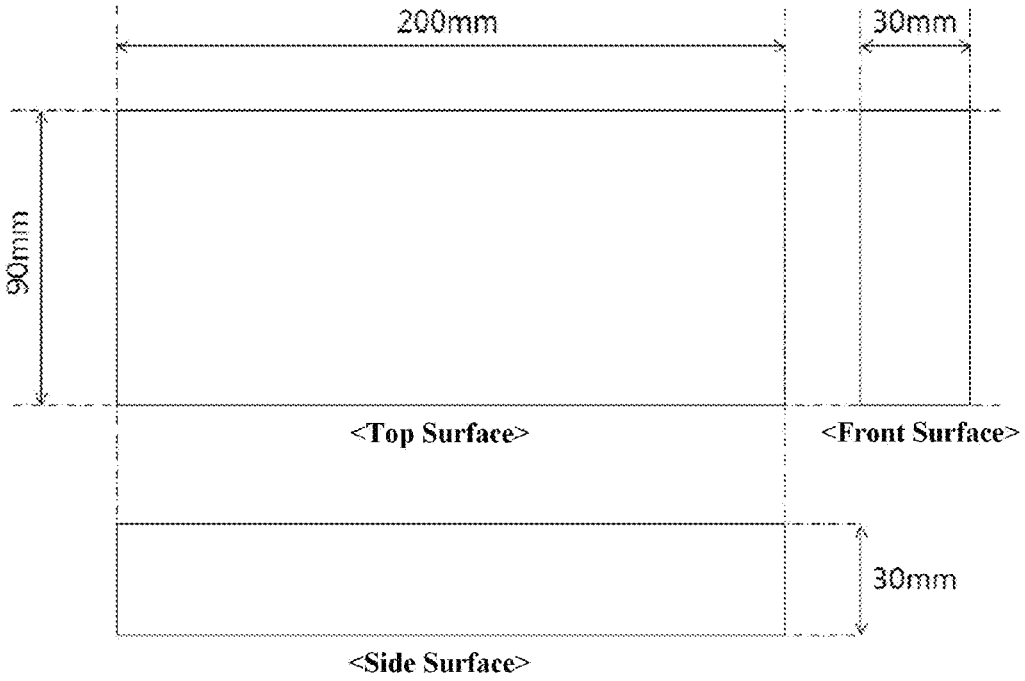
FIG. 3 illustrates a test specimen for measuring workability of the flake graphite cast iron according to the present disclosure.
Figure 4:
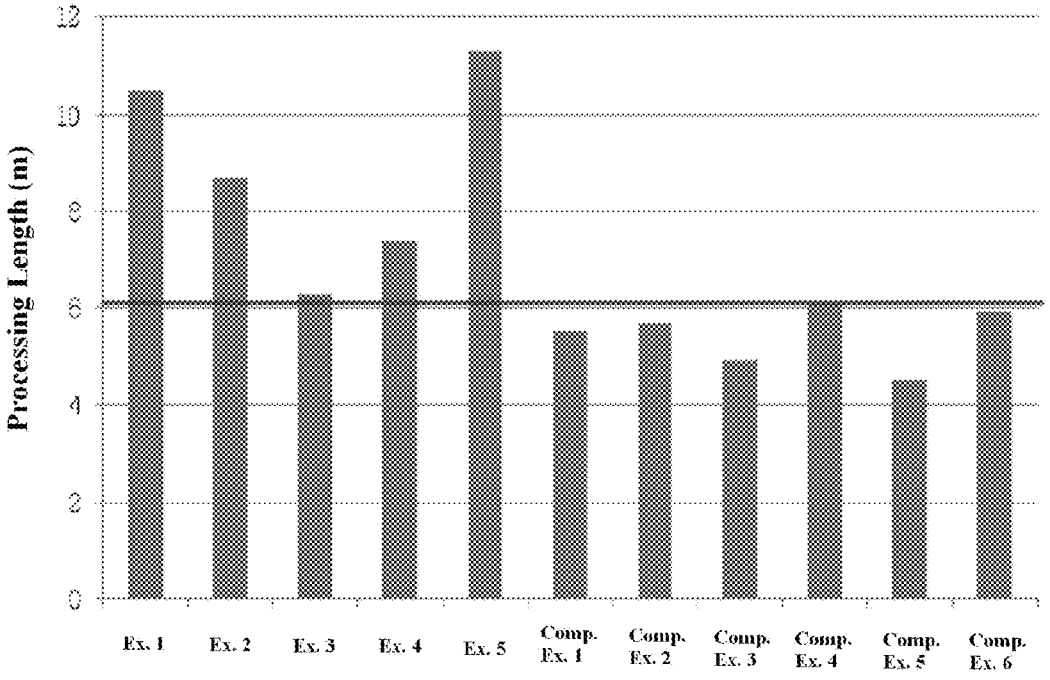
FIG. 4 illustrates the evaluation results of workability of the flake graphite cast iron according to the present disclosure.

According to an example of the present disclosure, in the case of processing a workability evaluation test specimen to which the flake graphite cast iron having the chemical composition is applied, when the VBmax as abrasion degree is 0.45, the processing length may be 6 m or more, preferably 6 m to 11 m. In this case, the workability evaluation test specimen may be illustrated as in the following FIG. 3, and the upper limit of the processing length in the workability evaluation test specimen is not particularly limited.

<Preparation Method of Flake Graphite Cast Iron>

The preparation method of the high strength and high workability flake graphite cast iron having the aforementioned chemical composition according to the present disclosure is as follows. However, the preparation method is not limited to the following preparation method, and if necessary, the step of each process may be modified or optionally mixed and performed.

When the explanation is made with reference to FIG. 1, first, 1) prepared is a cast iron melt including 3.05 to 3.25% of carbon (C), 2.1 to 2.4% of silicon (Si), 0.6 to 3.4% of manganese (Mn), 0.09 to 0.13% of sulfur (S), 0.04% or less of phosphorus (P), 0.6 to 0.8% of copper (Cu), 0.2 to 0.4% of molybdenum (Mo) and the balance iron (Fe) based on a total weight %.

The method for preparing the cast iron melt according to the present disclosure is not particularly limited, and as an example, a cast iron melt is prepared such that the aforementioned chemical composition is obtained by melting a cast iron material in which carbon (C), silicon (Si), manganese (Mn), sulfur (S) and phosphorus (P), which are five main elements of cast iron, are contained in the aforementioned content ranges in a furnace to prepare the cast iron melt, and adding alloy iron such as copper (Cu) and molybdenum (Mo) thereto.

Herein, phosphorus (P) may be included as an impurity in a raw material for casting, or may also be separately added. Meanwhile, in the present disclosure, since the reason for limiting the chemical composition in the melt is the same as the reason described in the case of the chemical composition of the flake graphite cast iron to be described above, the explanation thereof will be omitted.

What is important in this case is that the carbon equivalent (CE) of the flake graphite cast iron needs to be limited to a range from 3.8 to 4.0 when calculated by the method of CE=% C+% Si/3 while limiting the chemical composition of the flake graphite cast iron according to the present disclosure as described above, simultaneously adjusting the ratio (Mn/S) of the content of manganese (Mn) to the content of sulfur (S) in a range from 7 to 28, and adjusting the ratio [(Mn/S)/(C/Si)] of the content ratio of manganese and sulfur to the content ratio of carbon and silicon in a range from 5 to 18.

In the present disclosure, when the ratio of Mn/S is less than 7, reduction of the tensile strength is incurred, and when the ratio of Mn/S exceeds 28, workability may deteriorate. When the ratio of C/Si to Mn/S is high, flake graphite is easily produced and reaction chills are suppressed, but the tensile strength is reduced, and in contrast, when the ratio of C/Si to Mn/S is too low, the tensile strength is enhanced, but flake graphite is not well produced and reaction chills are increased. When the carbon equivalent (CE) is less than 3.8, casting defects and deterioration in workability are incurred, and when the carbon equivalent (CE) exceeds 4.0, the tensile strength is reduced due to excessive crystallization of process graphite. Accordingly, by limiting the ratio of Mn/S, the ratio of [(Mn/S)/(C/Si)] and the carbon equivalent (CE) as described above, an A type or A+D type flake graphite may be obtained even though manganese (Mn) as an element which reinforces the matrix and stabilizes carbides is added in a large amount in order to prepare high strength flake graphite cast iron, and it is possible to obtain a high strength flake graphite cast iron with a tensile strength of 350 MPa or more, reduced chillation, and excellent workability because the chillation is reduced.

In the cast iron melt prepared as described above, a component analysis of the melt is completed using a carbon equivalent measuring device, a carbon/sulfur analyzer and a spectrometer.

2) Thereafter, the cast iron melt is poured into a ladle which is a container for pouring, and then is injected into a prepared mold, and at this time, an Fe—Si-based inoculant may be added thereto at least one time.

As a preferred example of the step, in terms of stabilization of a material for high strength flake graphite cast iron, first, an Fe—Si-based inoculant is added simultaneously with the pouring (primary inoculation treatment), and next, the Fe—Si-based inoculant is added simultaneously with the injection (secondary inoculation treatment). In this case, the size of the inoculant to be input may be in a range from 0.5 to 3 mm in diameter, and it is preferred that the amount of the inoculant to be input during the ladle pouring is limited to 0.3±0.05% by weight (%) in order to obtain an effect of stabilizing the material for the high strength flake graphite cast iron.

The melt temperature of the ladle in which the pouring has been completed is measured by using an immersion-type thermometer. After the temperature is measured, the melt is injected into a prepared mold frame. It is preferred that the amount of the inoculant to be input during injection into the mold is limited to 0.3±0.05% by weight (%). Through the process, the preparation of the high strength flake graphite cast iron for an engine cylinder block and head is completed.

The high strength and high workability flake graphite cast iron of the present disclosure prepared as above has chilling tendency relatively lower than the flake graphite cast iron having a tensile strength of 350 MPa or more, and exhibits excellent workability. The chilling tendency is low even though manganese (Mn) is added in a large amount. Therefore, it is possible to apply the flake graphite cast iron to an engine cylinder block, an engine cylinder head or both, which have a complicated shape.

Hereinafter, Examples of the present disclosure will be described in more detail. However, the following Examples are exemplified for better understanding of the present disclosure only, and the scope of the present disclosure should not be construed to be limited thereto. Various modifications and changes can be made from the following Examples without departing from the spirit of the present disclosure.

Example 1 to 5 and Comparative Examples 1 to 61

Flake graphite cast iron according to Examples 1 to 5 and Comparative Examples 1 to 6 was prepared according to the compositions of the following Table 1.

TABLE 1

| Classification | C | Si | Mn | P | S | Cu | Mo | Mn/S | (Mn/S)/(C/Si) |
|---|---|---|---|---|---|---|---|---|---|
| Example 1 | 3.16 | 2.23 | 1.511 | 0.034 | 0.127 | 0.768 | 0.375 | 11.90 | 8.40 |
| Example 2 | 3.06 | 2.30 | 1.486 | 0.036 | 0.126 | 0.759 | 0.376 | 11.79 | 9.13 |
| Example 3 | 3.25 | 2.1 | 2.52 | 0.030 | 0.09 | 0.672 | 0.343 | 28 | 18 |
| Example 4 | 3.23 | 2.305 | 0.679 | 0.024 | 0.097 | 0.696 | 0.205 | 7 | 5 |
| Example 5 | 3.09 | 2.29 | 1.479 | 0.034 | 0.128 | 0.738 | 0.298 | 11.55 | 8.56 |
| Comparative Example 1 | 3.23 | 2.12 | 0.7 | 0.028 | 0.118 | 0.65 | 0.201 | 5.93 | 3.89 |
| Comparative Example 2 | 3.23 | 2.1 | 1.013 | 0.031 | 0.15 | 0.605 | 0.4 | 6.75 | 4.39 |
| Comparative Example 3 | 3.25 | 2.4 | 3.4 | 0.028 | 0.13 | 0.734 | 0.35 | 26.15 | 19.31 |
| Comparative Example 4 | 3.25 | 2.1 | 0.6 | 0.028 | 0.13 | 0.64 | 0.275 | 4.62 | 2.98 |
| Comparative Example 5 | 3.05 | 2.1 | 3.4 | 0.031 | 0.09 | 0.63 | 0.21 | 37.78 | 26.01 |
| Comparative Example 6 | 3.1 | 2.8 | 1.4 | 0.2 | 0.13 | — | — | 10.77 | 9.73 |

First, an initial melt containing carbon (C), silicon (Si), manganese (Mn), sulfur (S) and phosphorus (P) was prepared according to the composition of Table 1. Without being separately added, phosphorus (P) was used as an impurity included in a raw material for casting, but was adjusted such that the content thereof is 0.04% or less.

Before pouring, the carbon equivalent (CE) was measured by using a carbon equivalent measuring device and the content of carbon (C) was adjusted to 3.05 to 3.25%, and alloy iron such as copper (Cu), molybdenum (Mo) and manganese (Mn) was adjusted to the composition as described in Table 1. In this case, a primary inoculation was performed by inputting an Fe—Si-based inoculant simultaneously with the pouring. After the pouring into the ladle was completed, the temperature of the melt was measured and the melt was injected into a prepared mold. In this case, a flake graphite cast iron product for an engine cylinder block and head was prepared by inputting the Fe—Si-based inoculant simultaneously with the injection to perform a secondary inoculation.

The carbon equivalents, tensile strengths, processing lengths and chill depths of the cast iron in Examples 1 to 5 and Comparative Examples 1 to 6 prepared according to the composition in Table 1 were respectively measured and are shown in the following Table 2.

TABLE 2

| Classification | Carbon equivalent (C.E.) | Tensile strength (MPa) | Chill (mm) | Processing length (m) | Graphite type |
|---|---|---|---|---|---|
| Example 1 | 3.90 | 356 | 0 | 10.5 | A |
| Example 2 | 3.85 | 375 | 1 | 8.7 | A + D |
| Example 3 | 3.95 | 380 | 3 | 6.3 | A |
| Example 4 | 4.00 | 377 | 2 | 7.4 | A |
| Example 5 | 3.85 | 351 | 0 | 11.3 | A + D |
| Comparative Example 1 | 3.94 | 308 | 5 | 5.5 | A |
| Comparative Example 2 | 3.93 | 313 | 5 | 5.7 | A + E |
| Comparative Example 3 | 4.05 | 345 | 6 | 4.9 | A + E |
| Comparative Example 4 | 3.95 | 307 | 3 | 6.1 | A |
| Comparative Example 5 | 3.75 | 380 | 7 | 4.5 | E |
| Comparative Example 6 | 4.03 | 260 | 4 | 5.9 | A |

As seen from Table 2 above, it could be known that according to Examples 1 to 5 in which the ratio of Mn/S is adjusted to a range from 7 to 28, the ratio of [(Mn/S)/(C/Si)] is adjusted to a range from 5 to 18, the carbon equivalent (CE) is adjusted to a range from 3.8 to 4.0, the cast iron has a tensile strength of 350 MPa or more and a processing length in a range from 6 to 11 m. It could be known that the chill depth is 3 mm or less.

For reference, Comparative Examples 1 and 2 are the same as Examples 1 to 5 in terms of the content of the composition and the preparation process, but are examples in which both the ratio of Mn/S and the [(Mn/S)/(C/Si)] ratio of the content ratio of manganese and sulfur to the content ratio of carbon and silicon depart from the composition ranges of the present disclosure.

Comparative Example 3 is the same as Examples 1 to 5 in terms of the content of the composition and the preparation process, but are examples in which the [(Mn/S)/(C/Si)] ratio of the content ratio of manganese and sulfur to the content ratio of carbon and silicon and the carbon equivalent (CE) depart from the composition ranges of the present disclosure.

Comparative Examples 4 and 5 are examples in which both the content ratio (Mn/S) of manganese and sulfur and the [(Mn/S)/(C/Si)] ratio of the content ratio of manganese and sulfur to the content ratio of carbon and silicon depart from the composition ranges of the present disclosure. In particular, in Comparative Example 4, Mn/S greatly departs from the composition range of the present disclosure, and Comparative Example 5 is an example in which the carbon equivalent (CE) value fails to reach the range of the present disclosure.

Comparative Example 6 is an example in which both the content ratio (Mn/S) of manganese and sulfur and the [(Mn/S)/(C/Si)] ratio of the content ratio of manganese and sulfur to the content ratio of carbon and silicon correspond to the composition ranges of the present disclosure, but the carbon equivalent (CE) departs from the range of the present disclosure.

As a result, it can be known that the high strength flake graphite cast iron according to the present disclosure has both stable tensile strength and chill depth and workability, and thus may be usefully applied to a cast iron product which requires high strength such as a tensile strength of 350 MPa or more and excellent workability and has a complicated shape.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A flake graphite cast iron for use with an engine consisting of:

3.05 to 3.25% of carbon (C), 2.1 to 2.4% of silicon (Si), 0.600 to 1.099% of manganese (Mn), 0.09 to 0.13% of sulfur (S), 0.04% or less of phosphorus (P), 0.6 to 0.8% of copper (Cu), 0.2 to 0.4% of molybdenum (Mo), the balance iron (Fe) and other inevitable impurities satisfying 100% as a total weight %, and simultaneously satisfying a chemical composition wherein a ratio (Mn/S) of the content of manganese (Mn) to the content of sulfur (S) is in a range from 7 to 28, a ratio ((Mn/S)/(C/Si)) of the content ratio of manganese and sulfur to the content ratio of carbon and silicon is in a range from 5 to 18, a carbon equivalent (CE) is in a range from 3.8 to 4.0, and a tensile strength of 350 MPa or more.

2. The flake graphite cast iron of claim 1, wherein a processing length is 6 m or more when a VBmax is 0.45 during an evaluation of workability of a workability test specimen.

3. The flake graphite cast iron of claim 1, wherein a wedge test specimen has a chill depth of 3 mm or less.

4. A method for preparing flake graphite cast iron for use with the engine of claim 1, the method comprising:

(i) preparing a cast iron melt consisting of 3.05 to 3.25% of carbon (C), 2.1 to 2.4% of silicon (Si), 0.600 to 1.099% of manganese (Mn), 0.09 to 0.13% of sulfur (S), 0.04% or less of phosphorus (P), 0.6 to 0.8% of copper (Cu), 0.2 to 0.4% of molybdenum (Mo), the balance iron (Fe) and other inevitable impurities based on a total weight %, wherein a chemical composition of the cast iron melt is adjusted such that a ratio (Mn/S) of a content of manganese (Mn) to a content of sulfur (S) is in a range from 7 to 28, a ratio ((Mn/S)/(C/Si)) of a content ratio of manganese and sulfur to a content ratio of carbon and silicon is in a range from 5 to 18, and a carbon equivalent (CE) is in a range from 3.8 to 4.0; and (ii) pouring the prepared cast iron melt into a ladle and injecting the cast iron melt into a prepared mold.

5. The method of claim 4, wherein the cast iron melt in step (i) is prepared by adding the copper (Cu) and the molybdenum (Mo) to the cast iron melt prepared by melting a cast iron material including the carbon (C), the silicon (Si), the manganese (Mn), the sulfur (S), the phosphorus (P) and the iron (Fe).

6. The method of claim 4, wherein an Fe—Si-based inoculant is added one or more times in step (ii).

7. The method of claim 6, wherein the Fe—Si-based inoculant is added when the cast iron melt is poured into the ladle, when the cast iron melt is injected into the mold, or in all the steps.

* * * * *